US005885947A

United States Patent [19]

Maples

[11] Patent Number: 5,885,947

[45] **Date of Patent: *Mar. 23, 1999**

[54] DRY LUBRICANT

[76] Inventor: Paul D. Maples, 3198 Beachcomber Dr., Morro Bay, Calif. 93442

[ * ] Notice: This patent issued on a continued prosecution application filed under 37 CFR 1.53(d), and is subject to the twenty year patent term provisions of 35 U.S.C. 154(a)(2).

The term of this patent shall not extend beyond the expiration date of Pat. No. 5,472,625.

[21] Appl. No.: 772,755

[22] Filed: Dec. 23, 1996

Related U.S. Application Data

[63] Continuation of Ser. No. 566,680, Dec. 4, 1995, Pat. No. 5,670,463, which is a continuation-in-part of Ser. No. 209, 217, Mar. 11, 1994, Pat. No. 5,472,625.

[51] Int. Cl.[6] ..... C10M 105/04; C10M 105/06

[52] U.S. Cl. ..... 508/491; 508/459; 508/488; 508/539

[58] Field of Search ..... 508/488, 539, 508/459, 491

[56] References Cited

U.S. PATENT DOCUMENTS

| | | |
|---|---|---|
| 1,694,148 | 12/1928 | Spalding . |
| 1,920,202 | 8/1933 | Large . |
| 1,935,588 | 11/1933 | Cabot . |
| 1,953,904 | 4/1934 | Bowyer . |
| 2,386,553 | 10/1945 | Hilliker . |
| 2,391,113 | 12/1945 | Zimmer . |
| 2,393,797 | 1/1946 | Morgan . |
| 2,419,713 | 4/1947 | Flood . |
| 2,444,357 | 6/1948 | Maguire . |
| 3,201,361 | 8/1965 | Aron . |
| 3,692,678 | 9/1972 | Stiffler . |
| 4,260,500 | 4/1981 | Forsberg . |
| 5,213,180 | 5/1993 | Masonek et al. . |
| 5,472,625 | 12/1995 | Maples ..... 508/488 |

OTHER PUBLICATIONS

Holiday Catalog from Performance Bicycle (Dec. 1997).

*Primary Examiner*—Jacqueline V. Howard
*Assistant Examiner*—Cephia D. Toomer
*Attorney, Agent, or Firm*—Knobbe Martens Olson & Bear, LLP

[57] ABSTRACT

A light-duty, multi-purpose lubricant particularly formulated for use on the, diverse bearing surfaces mechanisms which operate in a dirty or dusty environment, such as bicycle chains. The lubricant comprises an insoluble soap, preferably Calcium Stearate in suspension in a volatile solvent-based solution of paraffin wax, petrolatum and a surfactant. After application and evaporation of the solvent the composite dry lubricant exhibits good penetration and load bearing properties without the dirt-retaining character of greases. The optional surfactant is surrounded and deactivated by the other components so that the dried lubricant is water repelling. The undissolved particles of soap combine with dirt particles to break-down portions of the lubricant into a dry flaky dust which is sloughed off the mechanism. Soluble waxes having different solid phase crystalline structures may be blended with the paraffin to reduce the rate of sloughing. The amount of solvent may be adjusted or eliminated depending on the application.

18 Claims, No Drawings

DRY LUBRICANT

PRIOR APPLICATION

This is a continuation of U.S. Ser. No. 08/566,680, filed Dec. 4, 1995, now U.S. Pat. No. 5,670,463 which is a continuation in part of U.S. Ser. No. 08/209,217, filed Mar. 11, 1994, now U.S. Pat. No. 5,472,625.

FIELD OF THE INVENTION

This invention relates to lubricants, and more particularly to the lubrication of mechanisms such as bicycle chains which are typically exposed to dirty or dusty environments.

BACKGROUND OF THE INVENTION

A bicycle chain is a complex structure that incorporates different mechanisms with specific and often contradictory lubrication requirements.

In the first place, a bicycle chain operates in a very dusty environment. Accordingly, its lubricant should be non-tacky, that is dry or of a low viscosity so as not to collect dust, and thereby encourage abrasion. This requirement would normally exclude greases in favor of solid lubricants. However, the unbalanced and relatively high pressure applied by the rollers of the chain against their cross axis call for a grease-type lubricant. Moreover, the shearing contact between the teeth of the driving sprockets and the outside surface of the beads can benefit from the bearing pressure provided by a grease as well as an adsorbed layer of a thin-film lubricant.

These problems have been addressed by a lubricant which in one embodiment comprises an insoluble soap dispersed in a volatile solvent-based solution of wax and petrolatum (petroleum jelly) available under the brand name WHITE LIGHTNING, available from Leisure Innovations, Inc., Morro Bay, Calif. This lubricant is described in detail in U.S. Pat. No. 5,472,625, which is incorporated herein by reference. In brief, the lubricant is applied in liquid form in which it penetrates to coat all surfaces of the chain. The solvent then evaporates leaving a solid protective film of wax and petrolatum as modified by the soap to discourage the accumulation of dirt.

This lubricant however, will not properly lubricate when it is applied to a wet chain. Chains can become wet in a variety of ways, such as: rain, cleaning with water or water-based cleaning agents, even cleaning with non-dry compressed air. The lubricant typically cannot penetrate ambient water held by capillary action on the various surfaces of the chain. As the solvent evaporates, the lubricant solidifies leaving portions of the chain un-contacted by lubricant. Some or all of the water may then evaporate, leaving voids between the chain and lubricant. Being solid, the lubricant cannot then flow into the voids. Although instructing the product user that the chain must be dry before applying the lubricant eliminates most of the problem, it is inconvenient for the user.

Accordingly, there is a need for a multi-functional lubricant specifically formulated to allow application on wet or dry bicycle chains and similar mechanisms operating in dusty or wet environments such as powered or manually driven household, gardening, farming, construction and industrial equipment.

SUMMARY OF THE INVENTION

It is an initial object of this invention to provide a dry, water-resistant, and environmentally safe lubricant for use on low to moderate speed and low to moderately high temperature mechanisms which are typically exposed to dirt particles. Examples of such mechanisms include bicycle chains, household items such as kitchen and garden appliances. Other examples include mechanisms which operate near combustion engines or other heat sources, such as mechanisms found on motorcycles, powered lawn equipment, farm equipment, forklifts, and other industrial or construction equipment.

It is a further object of this invention to provide a lubricant that will not attract or retain dirt particles, but will instead slough them off the mechanism while exhibiting good penetration and loading of bearing surfaces.

It is a further object of this invention to provide a lubricant in which the rate of the sloughing action may be adjusted by changing the concentration or character of a component.

It is a further object of this invention to provide a lubricant which can be applied to mechanisms which are wet or dry.

It is a further object of the invention to provide a lubricant which may be applied under cooler temperature conditions.

These and other valuable objects are achieved by an insoluble soap dispersed in a volatile solvent-based solution of: a wax, such as paraffin; a hydrocarbon, silicon or vegetable based oil or grease, such as petrolatum; and a surfactant. The surfactant allows the lubricant to displace water encountered on the chain. After evaporation of the solvent, the mixture of wax, soap and oil form a solid around the surfactant, deactivating it. In this way, the surfactant will not aid subsequent removal of the lubricant from the chain with water. The wax/soap/oil solid also forms a good penetrating and metal-healing film on the surfaces of the chain. Any import of dirt particles combine with the insoluble soap particles to break-down the bond between some of the wax and the oil. Thus forming dirt-carrying flakes that fall off the mechanism. The rate of sloughing may be adjusted by combining soluble waxes having different crystalline structures. The amount of solvent may be adjusted or eliminated depending on the application.

DESCRIPTION OF THE PREFERRED EMBODIMENT OF THE INVENTION

The preferred embodiment of the invention addresses the various requirements of an effective lubricant for bicycle chains and other similar mechanisms by combining three different types of anti-wear and anti-friction elements. These elements are combined with a volatile solvent and a surfactant for ease of application to both wet and dry mechanisms, and to form a thin, penetrating multi-functional film over the entire mechanism.

The first component is a soluble wax having a melting point between approximately 41 and 73 degrees Celsius (107° F.–162° F.) from about 6 to about 35 percent per total weight. For most applicatibns, a paraffin or slack wax with a melting point of about 46 degrees Celsius (116° F.) is preferred because of its high solubility in hydrocarbon solvents. In its solid state, wax forms a good bearing lubricant without the dirt-gathering character of greases. Besides paraffin waxes, microcrystalline, hydrogenated triglycerides, natural and synthetic spermaceti, and natural or synthetic waxes with similar melting point characteristics could be used, albeit at a higher cost. Alternately, the first component may be a combination or blend of soluble waxes having different crystalline structures to obtain modified performance characteristics, as will be described later.

The second component is approximately 0.3 to approximately 20 percent per total weight of a hydrocarbon, silicone, or non-oxidizing vegetable oil or grease, preferably petroleum jelly (petrolatum), 10 to 30 weight lubricating oil, synthetic silicone oil, or jojoba oil. For the sake of clarity, these oil and grease candidates will be referred to collectively as the oil component in this specification. For most applications the preferred range should fall within about 2 to 15 percent per total weight. The oil provides a penetrating lubricant as well as an adsorbable metal-healing film. The relatively low concentration of the oil component does not substantially increase the viscosity of the end product. The ability of these oils to be partially adsorbed by the metallic surface is believed to be a necessary compliment to the load-bearing characteristic of the wax element.

These two first elements are dissolved in a volatile solvent preferably selected from a group of straight-chain hydrocarbons having from 5 to 8 carbon atoms, and boiling points between about 35 and 110 degrees Celsius (95° F.–230° F.), or aromatic hydrocarbons such as Toluene and Xylene or from chlorinated hydrocarbon solvents such as Perchloroethylene, as well as Naphthas, Pentane and Hexane, or turpentine. The toxicity of Toluene and Perchloroethylene make them unavailable for certain applications. Pentane with a boiling point of about 35.5 degrees Celsius is difficult to store and handle under most ambient conditions. Hexane, because of its low cost, low toxicity and high solubility is the preferred choice. The solvent is simply a carrier which vaporizes shortly after application of the lubricant, and is therefore not considered to be one of its basic components. Therefore, any solvent or solvent blend which has a wax, oil and grease dissolving capability and is compatible with the soap component described below would be suitable. Depending on the application, the range for the concentration of the solvent component is about 35 to 90 percent per total weight of pre-application lubricant.

The next component of the lubricant is approximately 5 to 25 percent per total weight of a water-repellent salt from the reaction of a fatty acid preferably selected from a group of Stearic, Oleic, Linoleic, or Palmitic acids, with a metal that is a member of Group I, II or III on the periodic table, preferably selected from a group consisting of Aluminum, Barium, Calcium, Lithium, Magnesium, and Zinc. All the metallic soaps such as Naphthenate and Laurates, although not tested, are expected to be adequate. Calcium Stearate appears to be the most economical and practical choice.

This type of insoluble soap, just like a calcium-based grease, is an excellent dry lubricant in its own right under low temperature conditions. It can provide solid loading and extend the working life of the lubricant, but maintains a relatively low viscosity. The finely divided particles of insoluble soap suspended in the solution provide a large surface area of adhesion for the wax and oil components without becoming greasy, thus maintaining the dry, water and dirt-repelling character of the lubricant.

The next component is a surfactant which allows the lubricant to be applied to wet surfaces. The inclusion of this component is therefore optional depending on whether this feature is desired. When used, the concentration of surfactant should range from approximately 0.03 to 2.0 percent per total weight of lubricant. The surfactant reduces the surface tension of the lubricant, allowing it to penetrate into any ambient water adhering to the various surfaces of the chain. The surfactant makes the lubricant, while in liquid form, hydrophilic. Therefore, ambient water is absorbed into the liquid lubricant, and is thereby displaced by it. The solvent and water then evaporate, leaving a mixture of wax, oil and soap to form the solid lubricating film. The surfactant can be added to the solvent at any point during mixture of the components, either before the solvent is added or after.

An important feature of the invention is the deactivation of the surfactant as the lubricant becomes solid. As the solvent evaporates, the wax and oil form a matrix which encapsulates the surfactant with respect to any subsequently added water. In this way, the surfactant will not adversely affect the water-repelling nature of the solidified lubricant. In other words, even though the surface-active agent is still present, it is inactive, and the solvent-less lubricant will be hydrophobic.

Although numerous types of commercially available surfactants compatible with the other components and miscible with the solvent carrier are acceptable, the preferred surfactant is Octyphenoxypolyethoxyethanol-nonionic which is available under the brand name TRITON X 100 from Union Carbide, Danbury, Conn. This type of surfactant is preferred because it works well at low concentrations and is inexpensive.

Another important feature of the invention is the self-cleaning effect provided by the insoluble soap component. In its finely divided form, the soap weakens the cohesive bond of the wax and oil components. The bonds between, for example, paraffin and petrolatum are so weakened by contact with the soap that the introduction of a small amount of additional material such as dust or dirt will cause the integrity of part of the solid lubricant to disintegrate into small particles that flake away from the unaffected part of the lubricant. In that process, the bulk of the dust or dirt is sloughed away. The above-described phenomenon insures that even the most inaccessible areas of the lubricated surfaces are maintained in clean condition.

EXAMPLE 1

About 15:3 percent per total weight of Calcium Stearate is dispersed in a solution of about 6.9 percent of total weight of Petrolatum (petroleum jelly) and about 19.4 per percent of total weight of paraffin wax having a melting point of about 46.6 degrees Celsius (116° F.) with about 58.0 percent per total weight of Hexane and about 0.4 percent per total weight of Triton X 100 brand surfactant. After thorough mixing, the formulation was applied to all areas of a bicycle chain, and the excess wiped off with a rag. The formulation was allowed to dry to a solid, non-tacky film.

EXAMPLE 2

Approximately 14 percent per total weight of Aluminum Stearate dispersed in a solution of about 5 percent per total weight of 10 weight petroleum distillate lubricating oil, and about 15 percent per total weight of paraffin wax with a melting point of around 74 degrees Celsius (135° F.) dissolved in approximately 65 percent per weight of Perchloroethylene and approximately 1 percent per total weight surfactant.

EXAMPLE 3

Approximately 15 percent per total weight of Calcium Oleate suspended in a solution of about 5 percent per total weight of a 30 weight motor oil and about 18 percent per total weight of a paraffin wax with a melting point of around 52 decrees Celsius (125° F.) with a mixture of about 25 percent per total weight of Toluene, about 35 percent per total weight of Varnish Makers & Paints grade of Naphtha and about 2 percent per total weight of surfactant.

EXAMPLE 4

Approximately 15.3 percent per total weight of Calcium Stearate suspended in a solution of about 6.9 percent per total weight of jojoba oil and about 19.4 percent per total weight of a paraffin wax with a melting point of around 46.7 decrees Celsius (116° F.) with a mixture of about 58 percent per total weight of Hexane, and about 0.4 percent per total weight of Triton-X 100 brand surfactant.

EXAMPLE 5

Approximately 12.5 percent per total weight of Calcium Stearate suspended in a solution of about 8.0 percent per total weight of silicone oil (350 centipoise) and about 14.0 percent per total weight of a paraffin wax with a melting point of around 46.7 decrees Celsius (116° F.) with a mixture of about 65.2 percent per total weight of commercial paint grade turpentine, and about 0.3 percent per total weight of Triton-X 100 brand surfactant.

The rate at which the lubricant sloughs from the chain determines, to a large degree, how long an application of the lubricant lasts. Control of the sloughing rate can be accomplished by blending soluble waxes having different solid phase crystalline structures. It has been found that a blend of a first soluble wax such as paraffin wax and a second soluble wax such as a microcrystalline wax will reduce the rate at which the lubricant will slough from the chain. This, in turn, extends the useful life of a single application of lubricant. It is thought that the addition of the microcrystalline wax modifies the crystalline structure of the paraffin wax base as it solidifies. Other waxes having crystalline structures different from paraffin such as natural and synthetic spermaceti, and hydrogenated triglycerides, although not tested, are expected to be adequate. Microcrystalline wax having a melting point between approximately 60 and 85 degrees Celsius (about 140° F.–185° F.) appears to be the most economical and practical choice. When using a paraffin/microcrystalline blend, the blend should be at least about 75% paraffin by weight, the rest being microcrystalline. Example 6 below utilizes this type of wax blend.

EXAMPLE 6

Approximately 15.3 percent per total weight of Calcium Stearate is disbursed in a solution of about 6.9 percent per total weight of petrolatum, about 17.4 percent per total weight of paraffin wax having a melting point of about 116° F. and 2.0 percent microcrystalline wax having a melting point of around 182° F. with about 58 percent per total weight of hexane and about 0.4 percent per total weight of triton X 100 brand surfactant. In this example, the addition of the microcrystalline wax to the formation extends the useful life of an application of the lubricant between 20 and 30 percent over that of the formulation in Example 1.

Examples 1–6 are designed to work optimally in low-heat applications, such as bicycle chains. The following Example 7 is designed to be used on mechanisms which operate at moderately high temperatures such as: motorcycle chains, powered gardening equipment, farm equipment, forklifts, and other industrial equipment.

EXAMPLE 7

About 5.0 percent per total weight of Calcium Stearate is dispersed in a solution of about 0.3 percent per total weight of Petrolatum (petroleum jelly) and about 6.0 per percent of total weight of paraffin wax having a melting point of about 70.5 degrees Celsius (159° F.) with about 88.7 percent per total weight of Hexane. This formulation provides a dry lubricant which remains solid up to 68.3 degrees Celsius (155° F.). A typical use would be a motorcycle pivot point in close proximity to the engine where heavy lubricant solid loading is not as important as having a dry, dirt-resistant, self-cleaning lubricant.

The solubility of the components, particularly the wax component, within the solvent carrier is temperature dependent. Therefore, there is a trade-off between the solid loading of the pre-application lubricant and the lowest temperature at which the lubricant may be applied to the mechanism. In other words, the higher the application temperature, the more wax/soap/oil can be present in the lubricant. The preferred formulation will then depend on how the lubricant is to be used. For most applications and environments, the following component ranges will likely be satisfactory: the insoluble soap being within a range of 10% to 20% per total weight; the soluble wax being within a range of 14% to 25% per total weight; the oil being within a range of 4% to 10% per total weight; the volatile solvent being within a range of 50% to 75% per total weight; and the surfactant being within a range of 0.1% to 1.5% per total weight.

The preceding examples provide a lubricant which may be applied over a wide range of temperatures, between approximately 15 and 50 degrees Celsius (about 60° F.–120° F.). If application is to occur in a more controlled environment having a temperature range between about 27 and 50 degrees Celsius (about 80° F.–120° F.), the solids content of the lubricant in its pre-application form can be increased by up to 50 percent as in the following Example 8.

EXAMPLE 8

About 22.7 percent per total weight of Calcium Stearate is dispersed in a solution of about 10.3 percent of total weight of petrolatum and about 29.1 percent of total weight of paraffin wax having a melting point of about 46.7 degrees Celsius (116° F.) with about 37.3 percent per total weight of Hexane and about 0.6 percent per total weight of Triton-X 100 brand surfactant.

Conversely, bicycles and farm equipment stored outdoors during winter months require a lubricant which can be applied at lower temperatures as in Example 9 in which the application temperature can be as low as about 1.6 degrees Celsius (35° F.).

EXAMPLE 9

About 12.4 percent per total weight of Calcium Stearate is dispersed in a solution of about 5.9 percent of total weight of petrolatum and about 8.8 per percent of total weight of paraffin wax having a melting point of about 46.7 degrees Celsius (116° F.) with about 72.6 percent per total weight of Hexane and about 0.3 percent per total weight of Triton-X 100 brand surfactant.

Although the preferred embodiment uses a volatile solvent to allow the lubricant to be easily applied and to adequately penetrate complex mechanisms, it is possible for the lubricant to be applied without solvent. The lubricant may be created in solid block or stick form and applied to the mechanisms by rubbing. Alternately, the lubricant may be applied in a hot, melted form. Clearly, however, these methods offer limited coverage and penetration.

While the preferred embodiment of the invention has been described, modifications can be made and other embodiments may be devised without departing from the spirit of the invention and the scope of the appended claims.

What is claimed is:

1. A multi-functional, light duty lubricant comprising:

an insoluble particulate lubricant within a range of approximately 5% to approximately 25% per total weight in suspension in a solution of:

a soluble wax within a range of approximately 6% to approximately 35% per total weight;

an oil within a range of approximately 0.3% to approximately 20% per total weight, wherein said oil is selected from the group consisting of hydrocarbon oils and greases prepared therefrom, silicone oils and greases prepared therefrom, and vegetable oils and greases prepared therefrom;

a volatile solvent within a range of approximately 35% to approximately 90% per total weight; and a surfactant within a range of approximately 0.03% to approximately 2.0% per total weight.

2. The lubricant of claim 1, wherein said lubricant has properties such that when said solvent evaporates a bond is formed between a portion of said wax and a portion of oil, said bond being weakened by a portion of said insoluble particulate lubricant whereby said bond is breakable when a foreign dust particle contacts said bonded wax and oil portions.

3. The lubricant of claim 1, wherein said insoluble particulate lubricant comprises finely divided particles of an insoluble hydrocarbon material whereby said particles provide a surface for adhesion of said wax and said oil.

4. The lubricant of claim 1, wherein said insoluble particulate lubricant comprises a metal salt of stearic, oleic, linoleic or palmitic acid.

5. The lubricant of claim 1, wherein said insoluble particulate lubricant comprises a aluminum, barium, calcium, lithium, magnesium or zinc salt of stearic acid.

6. The lubricant of claim 1, wherein said oil is a lubricating oil distillate.

7. The lubricant of claim 6, wherein said lubricating oil distillate is Petrolatum.

8. The lubricant of claim 1, wherein wax is a paraffin wax, microcrystalline wax, hydrogenated triglyceride, synthetic spermaceti or natural wax.

9. The lubricant of claim 8, wherein said natural wax is spermaceti.

10. The lubricant of claim 1, wherein said volatile solvent is selected from the group consisting of straight-chain hydrocarbons having from 5 to 8 carbon atoms and boiling points between approximately 35° C. and approximately 110° C., aromatic hydrocarbons and turpentine.

11. The lubricant of claim 1, wherein the soluble wax has a melting point between approximately 41° C. and approximately 85° C.

12. The lubricant of claim 1, wherein:

said insoluble particulate lubricant is within a range of 10% to 20% per total weight;

said soluble wax is within a range of 14% to 25% per total weight;

said oil is within a range of 4% to 10% per total weight;

said volatile solvent is within a range of 50% to 75% per total weight; and said surfactant is within a range of 0.1% to 1.5% per total weight.

13. The lubricant of claim 1, wherein said soluble wax is a wax blend comprising a first soluble wax and a second soluble wax having different solid phase structures.

14. The lubricant of claim 13, wherein said blend comprises at least 75% by weight of said first soluble wax.

15. The lubricant of claim 13, wherein said first soluble wax has a melting point of between approximately 41° C. and approximately 73° C., and said second soluble wax has a melting point between approximately 65° C. and approximately 85° C.

16. The lubricant of claim 13, wherein said first soluble wax is a paraffin wax, and said second soluble wax is a microcrystalline wax, hydrogenated triglyceride, synthetic spermaceti or natural wax.

17. A multi-functional, light duty lubricant comprising:

5 to 25 percent total weight of an insoluble particulate lubricant, in suspension in a solution of:

6 to 35 percent total weight of a soluble wax having a melting point between about 45° C. and 55° C.;

2 to 15 percent total weight of a hydrocarbon lubricant; and

35–90 percent total weight of a volatile hydrocarbon solvent; and wherein the insoluble particulate lubricant is in finely divided form having the property of weakening cohesive bonds between the hydrocarbon lubricant and the soluble wax such that the introduction of dust or dirt will cause a part of the light duty lubricant to flake away from the remainder of the lubricant.

18. A method for lubricating a moving part exposed to dirt or other contaminants, comprising the steps of:

applying a lubricant formulation to the part, the lubricant formulation comprising a soluble wax and a hydrocarbon, silicone or natural oil or grease solubilized in a volatile hydrocarbon solvent, and a finely divided insoluble particulate material having the property of weakening bonds within the lubricant formulation;

evaporating the solvent from the lubricant formulation to leave a solid film of lubricant on the part; and then as contaminants contact the lubricant, allowing a portion of the lubricant to flake away, together with the contaminants, as a result of the weakening of the bonds between the particulate material and the remainder of the lubricant formulation.

* * * * *